US011291898B2

(12) United States Patent
Furey

(10) Patent No.: US 11,291,898 B2
(45) Date of Patent: Apr. 5, 2022

(54) PORTABLE BASEBALL TEE ASSEMBLY WITH MECHANICAL AUTOLOADING FEATURES

(71) Applicant: Christopher G. Furey, Fallsington, PA (US)

(72) Inventor: Christopher G. Furey, Fallsington, PA (US)

( * ) Notice: Subject to any disclaimer, the term of this patent is extended or adjusted under 35 U.S.C. 154(b) by 19 days.

(21) Appl. No.: 17/098,381

(22) Filed: Nov. 14, 2020

(65) Prior Publication Data

US 2022/0054918 A1 Feb. 24, 2022

Related U.S. Application Data

(60) Provisional application No. 63/069,531, filed on Aug. 24, 2020.

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01)

(58) Field of Classification Search
CPC ..... A63B 69/0075; A63B 69/0002; A63B 2069/0008
USPC ..... 473/417, 422
See application file for complete search history.

(56) References Cited

U.S. PATENT DOCUMENTS 1,481,105 A * 1/1924 Jules ..... A63F 7/249 473/418
1,754,495 A * 4/1930 Bank ..... A63B 57/203 473/351
2,322,212 A * 6/1943 Allen ..... F42B 8/10 434/24
2,760,807 A * 8/1956 Watson ..... A63B 47/02 473/286
3,111,314 A * 11/1963 Topper ..... A63B 60/38 473/457
3,412,897 A * 11/1968 Charles ..... A63B 47/002 221/226
3,550,938 A * 12/1970 Cunningham, Jr. ... A63B 69/40 473/429
4,058,336 A * 11/1977 Parkinson ..... A63B 47/02 294/19.2
4,323,047 A * 4/1982 McIntosh ..... A63B 69/406 124/1
4,424,969 A * 1/1984 Dumas ..... A63B 47/002 124/51.1
4,610,373 A 9/1986 Sherbondy
(Continued)

*Primary Examiner* — Mitra Aryanpour
(74) *Attorney, Agent, or Firm* — LaMorte & Associates PC

(57) ABSTRACT

A batting tee system that can be used to both tee a ball for batting and retrieve balls on the ground. As balls are retrieved, the balls are automatically positioned for use in batting. The batting tee system uses a tube body having an interior and an open first end of a first diameter. An expandable constraint is disposed at the first end. The expandable constraint defines a secondary opening that can be selectively altered between a second diameter that is smaller than the first diameter, and a third diameter that is larger than the first diameter. A mechanical activator is used to alter the secondary opening of the expandable constraint between the second diameter and the third diameter. This controls the passage of balls out of the tube body.

19 Claims, 6 Drawing Sheets

(56) References Cited

U.S. PATENT DOCUMENTS

| | | | | | |
|---|---|---|---|---|---|
| 5,069,451 | A | * | 12/1991 | Martens | A63B 47/002 473/446 |
| 5,097,985 | A | * | 3/1992 | Jones | A63B 47/002 124/48 |
| 5,188,410 | A | | 2/1993 | Summers | |
| 5,294,109 | A | * | 3/1994 | Meade | A63B 69/40 124/50 |
| 5,466,027 | A | * | 11/1995 | Hockey | A63B 47/02 294/19.2 |
| 5,639,133 | A | | 6/1997 | Mote | |
| 5,672,124 | A | | 9/1997 | Pecoraro et al. | |
| 6,099,417 | A | | 8/2000 | Brown | |
| 6,416,429 | B1 | | 7/2002 | Pecoraro et al. | |
| 6,695,723 | B2 | | 2/2004 | Leal | |
| 6,926,623 | B2 | | 8/2005 | Lin | |
| D606,603 | S | * | 12/2009 | Compton | A63B 69/0002 D21/721 |
| 8,425,352 | B1 | * | 4/2013 | Loduca | A63B 69/0079 473/418 |
| 2003/0203773 | A1 | | 10/2003 | Leal et al. | |
| 2006/0019774 | A1 | | 1/2006 | Lin | |
| 2007/0010353 | A1 | | 1/2007 | Huang | |

* cited by examiner

PORTABLE BASEBALL TEE ASSEMBLY WITH MECHANICAL AUTOLOADING FEATURES

RELATED APPLICATIONS

This application claims the benefit of U.S. Provisional Patent Application No. 63/069,531, filed Aug. 24, 2020.

BACKGROUND OF THE INVENTION

1. Field of the Invention

The present invention relates to batting tees that hold a ball at an elevated position so that the ball can be struck with a bat. More particularly, the present invention relates to batting tees that contain a mechanism for loading a ball onto the tee and/or collecting loose balls from the ground.

2. Prior Art Description

Batting tees are often used when practicing for the game of baseball and softball. Batting tees are used for batting practice. Batting tees are also useful for coaches to hit balls into the field for fielding practice. In the simplest form of a batting tee, a single ball is placed atop a tee stand in a position that enables the ball to be struck by a bat. The primary problem with such a batting tee is that the user must physically place a ball onto the tee each time a ball is struck off the tee. This requires the user to repeatedly bend, collect balls, and place those balls, one at a time, atop the tee. This process consumes a lot of time and energy. It also detracts from the ability of a batter to develop muscle memory and create a smooth swing by repeatedly and rapidly hitting balls.

In the prior art, there are many batting tees that come with ball reservoirs. The ball reservoirs are adjacent the tee and load balls onto the tee upon the activation of a mechanical loading mechanism. Such prior art tees are exemplified by U.S. Patent Application Publication No. 2007/0010353 to Huang. A problem associated with such prior art tees is that the ball reservoir is easily disrupted should the tee accidentally be struck by the bat. If the tee is struck by the bat, the tee moves and/or falls over. This spills the balls being held in the reservoir.

In the prior art, more sophisticated batting tees have been designed that are large enough to absorb a bat strike without disruption. Such batting tees commonly contain motorized mechanism for loading balls onto the tee. Such prior art batting tees are exemplified by U.S. Pat. No. 6,416,429 to Pecoraro and U.S. Pat. No. 5,672,124 to Pecoraro. The obvious problem associated with such prior art batting tees is that the tees are large and heavy. As such, they are difficult to transport and setup. Furthermore, such prior art tees must be connected to a power source, which is usually lacking on a baseball field.

Although there are many baseball tees that contain autoloading features, most all prior art batting tees are designed to be set in a single position, such as home plate. After balls have been hit from the batting tee, someone has to walk around and pick up the balls. The balls must then be returned and loaded into the batting tee. If a player is practicing by himself/herself, collecting balls takes a great deal of time and requires that a player bend to collect balls many dozens of times. In the prior art, there are devices that a ball player can carry to help that player collect balls from the ground without bending. Such prior art devices are exemplified by U.S. Pat. No. 5,188,410 to Summers and U.S. Pat. No. 4,058,336 to Parkinson. Such prior art ball collection devices are separate and distinct from prior art batting tees. As a result, if a person wants to use both a batting tee and a ball retrieval device, both devices would have to be carried to and from a practice field.

A need therefore exists for a batting tee system that can hold multiple balls and load the balls upon the head of the tee for hitting, wherein the batting tee system is compact, lightweight, easy to transport and does not require any electrical power source. In addition, a need exists for a batting tee that can also be used as a ball retrieval device for collecting balls from the ground, wherein the collected balls are automatically queued for use in the batting tee. These needs are met by the present invention as described below.

SUMMARY OF THE INVENTION

The present invention is a batting tee system that can be used to both tee a ball for batting and retrieve balls on the ground. As balls are retrieved, the balls are automatically positioned for use in batting.

The batting tee system uses a tube body having an interior and an open first end of a first diameter. An expandable constraint is disposed at the first end of the tube body. The expandable constraint defines a secondary opening that can be selectively altered between a second diameter that is smaller than the first diameter of the tube body, and a third diameter that is larger than the first diameter.

A mechanical activator is used to alter the secondary opening of said expandable constraint between the second diameter and the third diameter. This controls the passage of balls out of the tube body. Balls are held in the tube body and are biased against the expandable constraint. When activated, the expandable constraint momentarily expands and enables one ball to pass out of the tube body. The ball comes to rest atop the expandable constraint where it is ready to be hit by a batter. As such, multiple balls can be sequentially loaded on the batting tee system without the batter having to bend and physically set the balls.

After the balls are struck into the field, the batting tee system is inverted and is used to recapture the balls simply by pressing the expandable constraint against the balls. The balls captured are automatically loaded into position for use when batting from the tee.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention batting tee system can be constructed in many ways, only one exemplary embodiment is illustrated and described. The illustrated embodiment is selected in order to set forth one of the best modes contemplated for the invention. It will be understood that the illustrated embodiment is merely exemplary and should not be considered a limitation when interpreting the scope of the appended claims.

Figure 1:
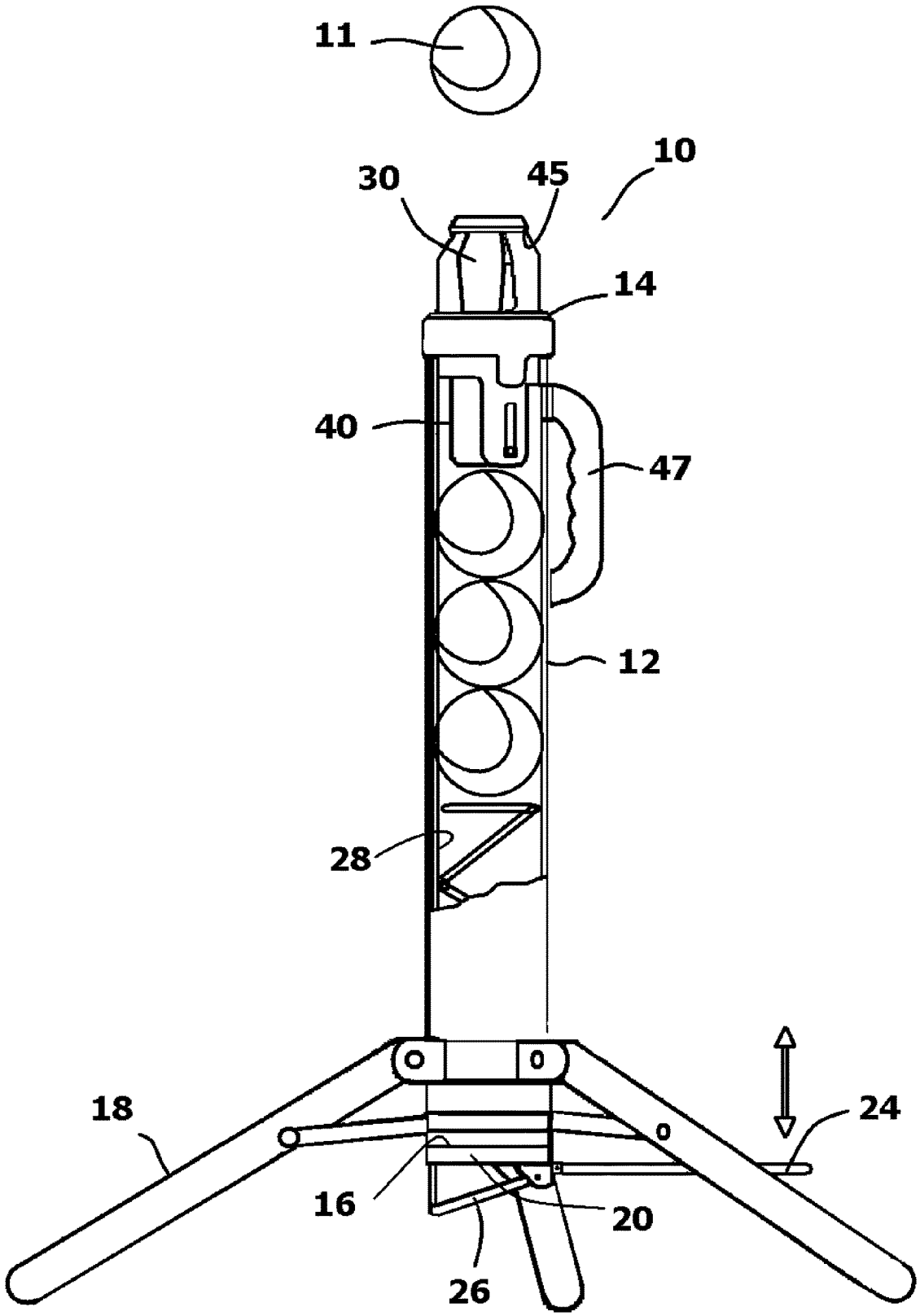
FIG. 1 is a fragmented side view of an exemplary batting tee system in a ball batting configuration, shown in conjunction with baseballs.
Figure 2:
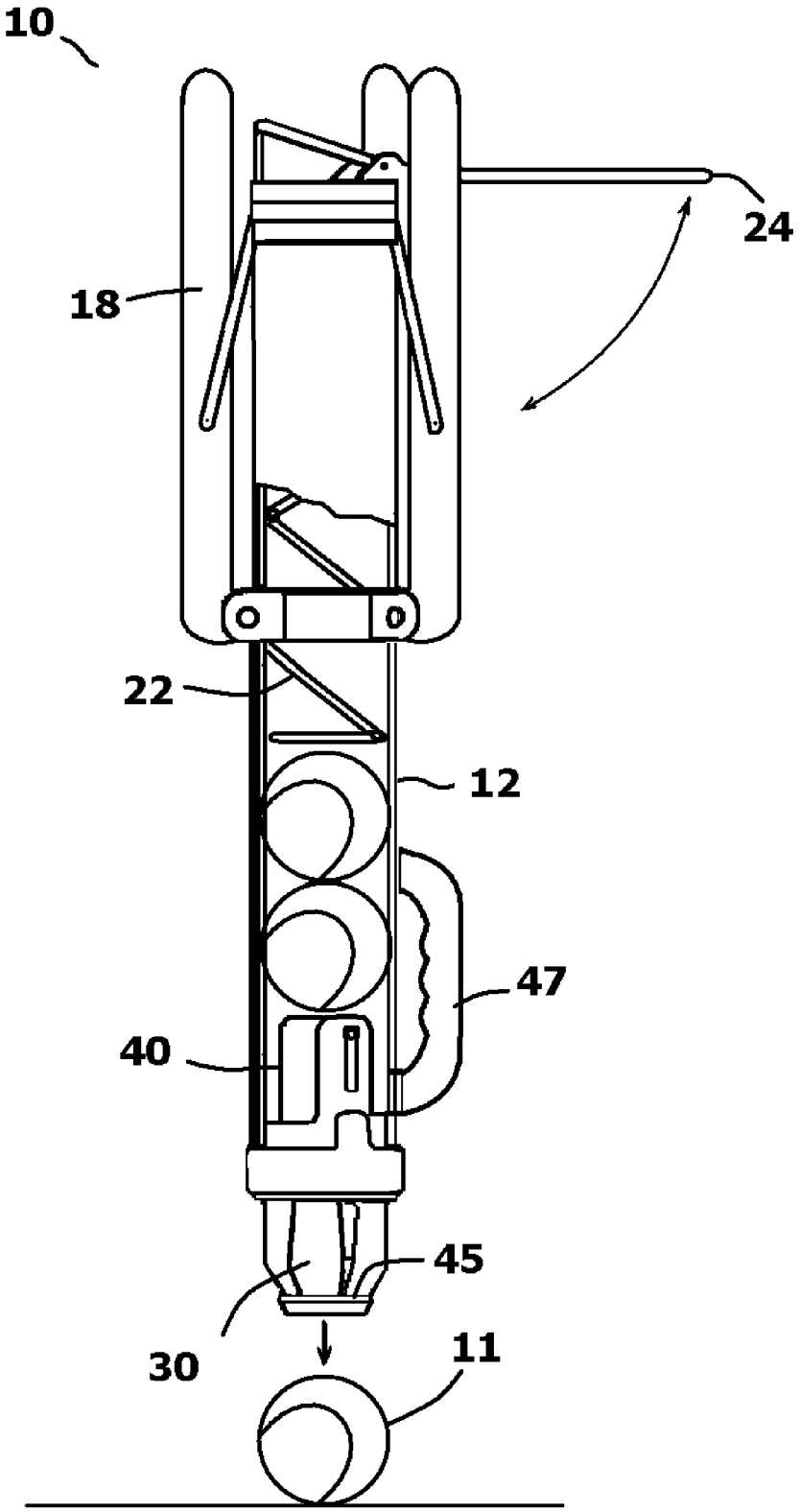
FIG. 2 is a fragments side view of an exemplary batting tee system open in an inverted ball collection configuration and shown in conjunction with baseballs.

Referring to FIG. 1 and FIG. 2, a batting tee system 10 is shown. The batting tee system 10 has two functions. In its first function, the batting tee system 10 holds a single ball 11 in an elevated position so that the ball 11 can be hit with a bat. In its secondary function, the batting tee system 10 is used to pick up, store and transport multiple balls 11. The batting tee system 10 also contains a loading mechanism that loads the balls 11 stored within the batting tee system 10 into a position where the balls 11 can be struck by a bat.

The batting tee system 10 has a tube body 12. The tube body 12 has a first end 14 and an opposite second end 16. The tube body 12 has an interior diameter that is large enough to fit a ball 11, such as a baseball. A collapsible stand 18 is attached to the tube body 12 near the second end 16 of the tube body 12. The collapsible stand 18 can be moved between a folded configuration (FIG. 2) and a deployed configuration (FIG. 1). In its deployed condition, the collapsible stand 18 can support and hold the tube body 12 in a vertical orientation.

The second end 16 of the tube body 12 is closed with a vented cap 20. Inside the tube body 12, a long spring 22 is provided that rests upon the vented cap 20. The long spring 22 has an uncompressed length that causes it to extend through most of length of the tube body 12.

An activation lever 24 is provided near the second end 16 of the tube body 12. The activation lever 24 is connected to a linkage 26 and a push rod 28. The push rod 28 runs along the length of the tube body 12 and can be positioned either inside or outside of the tube body 12. When the activation lever 24 is depressed, the push rod 28 is caused to move upwardly in the vertical direction. As is indicated in FIG. 2, the activation lever 24 can fold against the tube body 12, when not in use.

Figure 3:
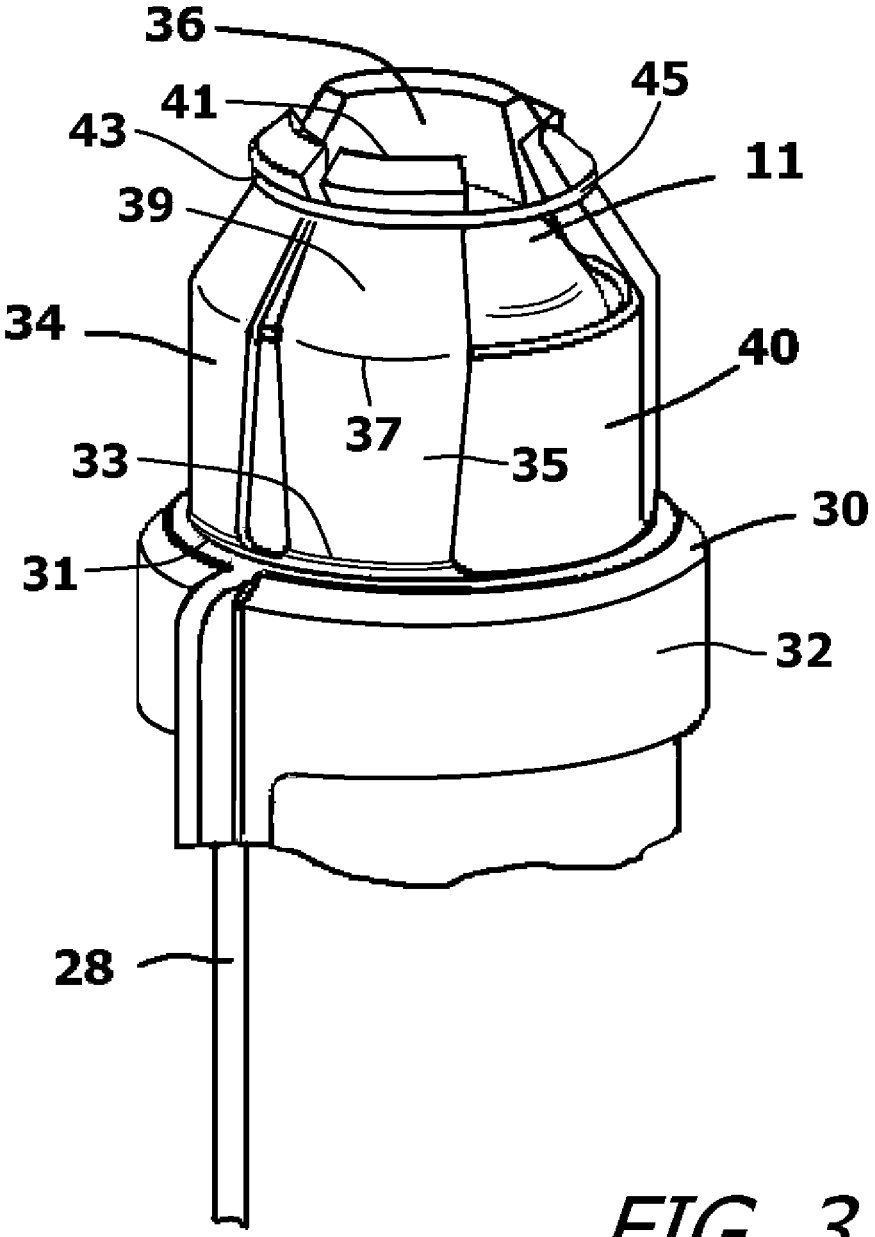
FIG. 3 is an enlarged view of the expandable constraint atop the tube body, wherein the expandable constraint is in an unexpanded condition.

Referring to FIG. 3 in conjunction with FIG. 1, it can be seen that the first end 14 of the tube body 12 terminates with an expandable constraint 29. The expandable constraint 29 can take several forms, such as an interference ring, an expanding iris or the like. In the shown embodiment, the expandable constraint 29 is configured as a finger cap 30. The finger cap 30 has an annular base 32 that connects to the tube body 12. A plurality of flexible fingers 34 extend from the annular base 32. The flexible fingers 34 converge and form a secondary opening 36 above the first end 14 of the tube body 12. The first end 14 of the tube body 12 has a first diameter that is large enough to enable the passage of the ball 11. The secondary opening 36 formed by the flexible fingers 34 has a second diameter that is smaller than the diameter of the ball 11. The flexible fingers 34, however, can be selectively deformed, therein expanding the secondary opening 36 to a third diameter that is slightly larger than the diameter of the ball 11.

Each of the flexible fingers 34 has a bottom 31 that is attached to the annular base 32. The flexible fingers 34 are preferably integrally molded with the annular base 32. A slight living hinge 33 can be molded at the transition to enhance the ability of the flexible fingers 34 to bend when stressed. Each of the flexible fingers 34 has a vertical section 35 that extend vertically from the annular base 32 when not stressed. Each of the flexible fingers 34 has a bend 37 where the flexible fingers 34 bend from the vertical section 35 to an inclined section 39. Each inclined section 39 extends from the bend 37 to a top end 41. The top end 41 of each flexible finger 34 is flared, therein creating a small ledge 43 on the exterior of the flexible fingers 34 just below the top end 41.

An elastic ring 45 is provided. The elastic ring 45 is retained by the small ledge 43 on the exterior of the flexible fingers 34. The elastic ring 45 biases the flexible fingers 34 toward one another, but allows for the deformation of the flexible fingers 34 and the expansion of the secondary opening 36.

The flexible fingers 34 can be selectively deformed by the movement of a cylindrical spacer 40 within the tube body 12. The cylindrical spacer 40 extends into the first end 14 of the tube body 12. The cylindrical spacer 40 has an outside diameter that is smaller than the inside diameter of the tube body 12 and an inside diameter that is larger than the diameter of the ball 11. The cylindrical spacer 40 extends from the tube body 12 and contacts the interior of the flexible fingers 34 at the bends 37 between the vertical sections 35 and the inclined sections 39 of the flexible fingers 34. The cylindrical spacer 40 is attached to the push rod 28. Accordingly, the cylindrical spacer 40 moves with the push rod 28 when the activation lever 24 is depressed.

Figure 4:
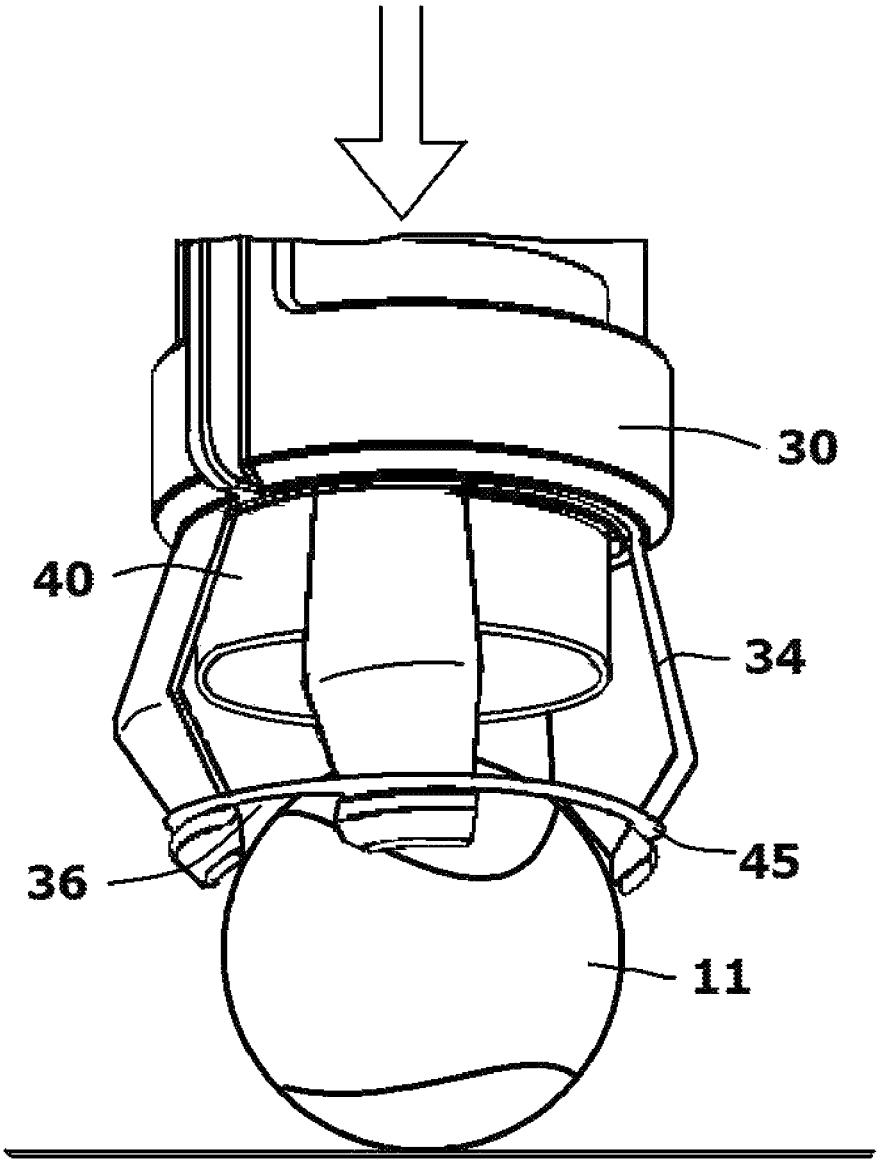
FIG. 4 is an enlarged view of the expandable constraint atop the tube body, during a ball recovery procedure.
Figure 5:
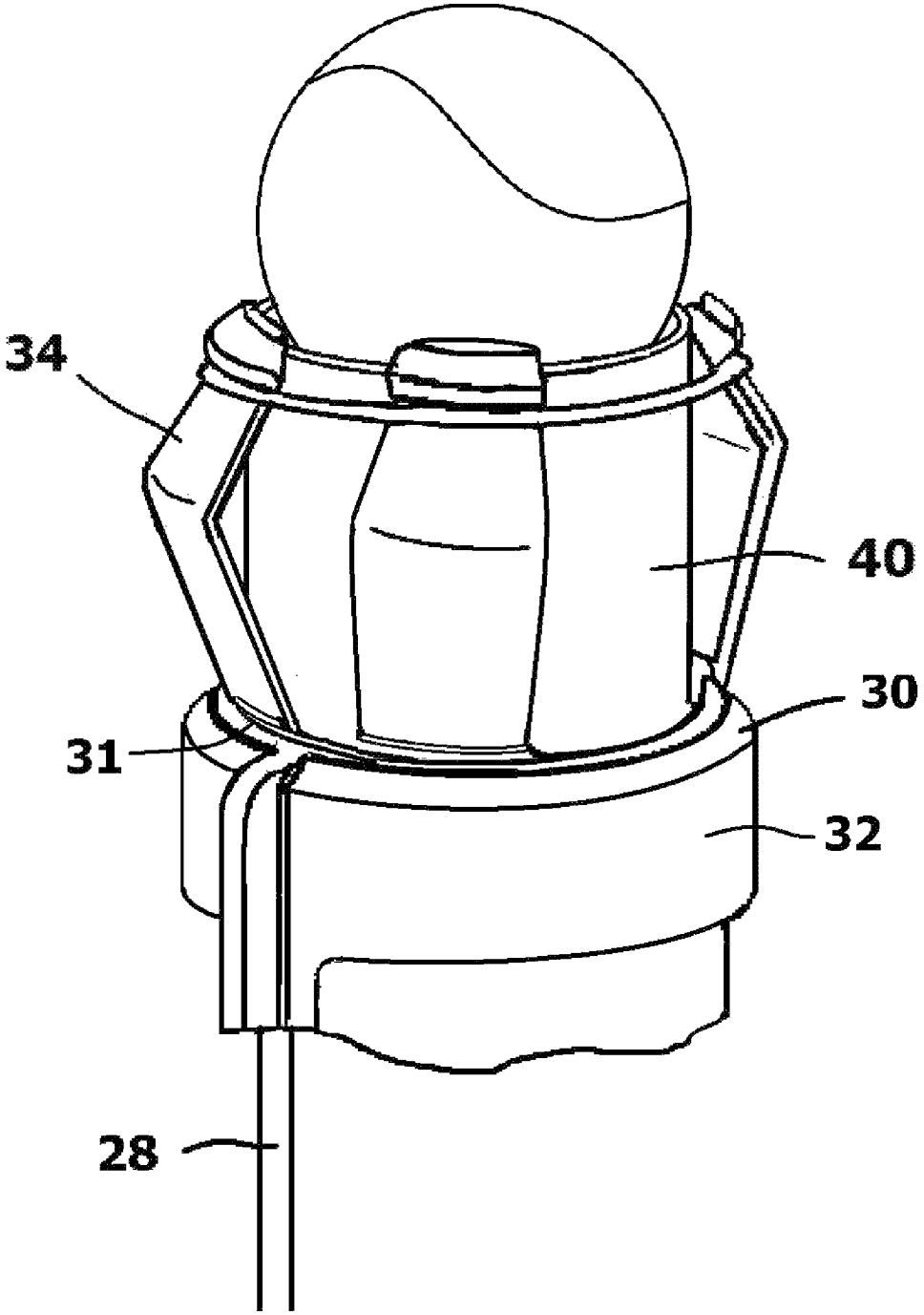
FIG. 5 is an enlarged view of the expandable constraint atop the tube body, wherein the expandable constraint is expanding to set a ball for hitting.

Referring to FIG. 4 in conjunction with FIG. 5 and FIG. 1, it will be understood that to load balls 11 into the batting tee system 10, the collapsible stand 18 is closed into its folded configuration. A handle 47 is provided on the exterior of the tube body 12. Using the handle 47, the tube body 12 is lifted and inverted so that the finger cap 30 is facing the ground. The finger cap 30 can then be positioned against any ball 11 resting upon the ground. The ball 11 is positioned under the secondary opening 36 between the flexible fingers 34. When the finger cap 30 is pressed against a ball 11, the flexible fingers 34 are deformed by the curved surface of the ball 11 and the secondary opening 36 expands. This enables the ball 11 to pass through the secondary opening 36 of the finger cap 30 and enter the first end 14 of the tube body 12. Once the ball 11 passes the inclined sections 39 of the flexible fingers 34, the flexible fingers 34 return to their original positions and the ball 11 is trapped within the tube body 12. The return of the flexible fingers 34 to their original positions is due in part to the plastic material of the flexible fingers 34 and in part to the elastic ring 45.

As additional balls 11 are added into the tube body 12, the balls 11 begin to fill the tube body 12 and compress the long spring 22 toward the second end 16 of the tube body 12. Conversely, the long spring 22 biases the balls 11 toward the secondary opening 36 of the flexible fingers 34.

Once the tube body 12 is full, the tube body 12 can again be rotated so that the first end 14 of the tube body 12 vertically positioned above the second end 16. The collapsible stand 18 is opened so that the tube body 12 becomes self-standing in a vertical orientation. In this orientation the long spring 22 biases the balls 11 upwardly against the finger cap 30. However, the force of the long spring 22 is insufficient to deform the flexible fingers 34 and spread the elastic ring 45. As a result, a ball 11 becomes trapped under the finger cap 30.

Figure 6:
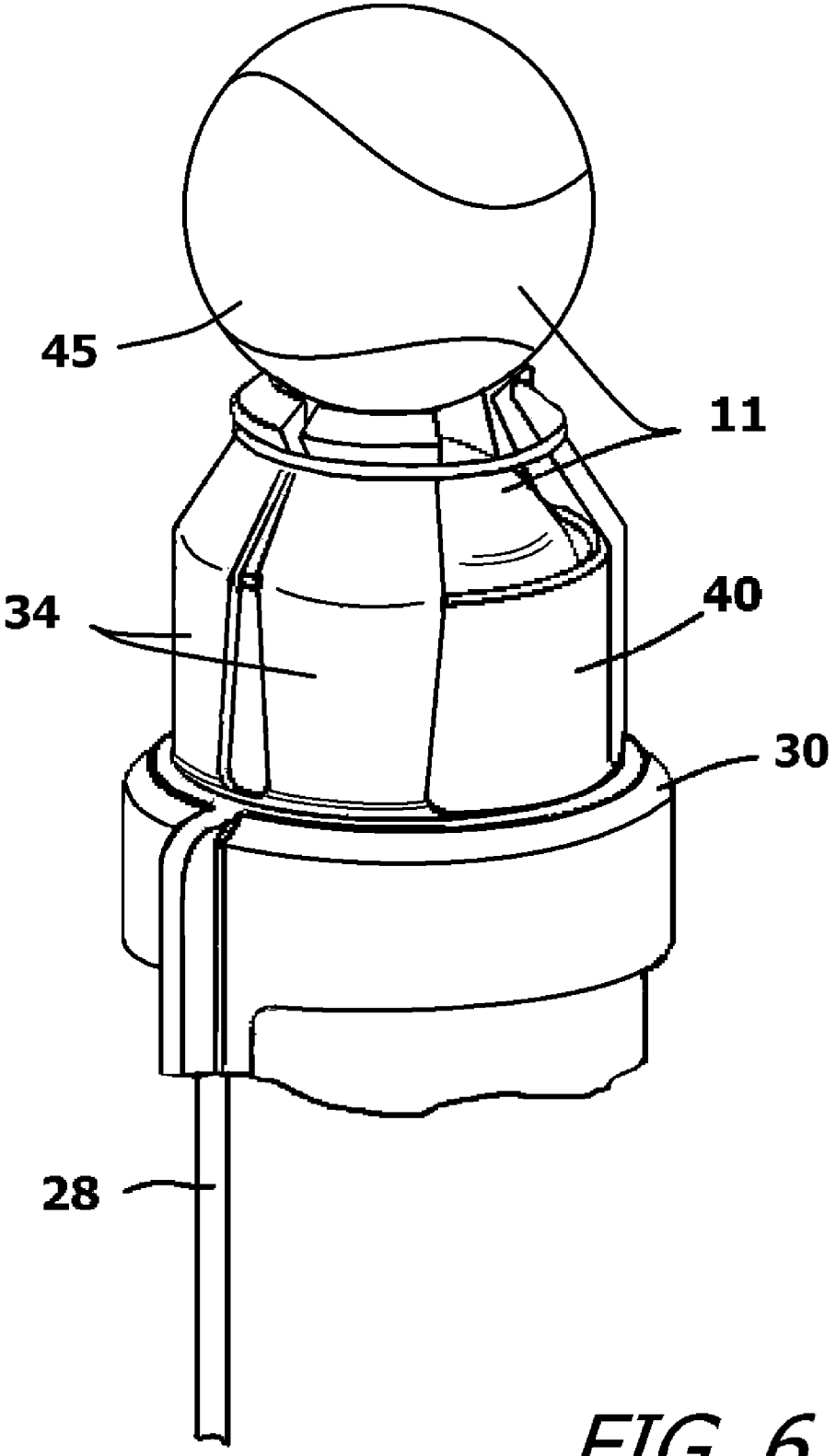
FIG. 6 is an enlarged view of the expandable constraint atop the tube body, wherein the expandable constraint retains a ball ready for hitting.

Referring to FIG. 4, FIG. 5 and FIG. 6, in conjunction with FIG. 1 and FIG. 2, it can be seen that if a person steps on the activation lever 24, the push rod 28 is driven upwardly. The push rod 28 is connected to the cylindrical spacer 40. As the cylindrical spacer 40 is driven into the finger cap 30 by the push rod 28, the cylindrical spacer 40 contacts the inclined sections 39 of the flexible fingers 34. As the cylindrical spacer 40 advances, force of the cylindrical spacer 40 overcomes the counter force of the elastic ring 45 and the flexible fingers 34 spread. Within the tube body 12, the balls 11 are biased against the secondary opening 36 of the flexible fingers 34 by the long spring 22. As the secondary opening 36 of flexible fingers 34 are spread to the diameter of the ball 11, the long spring 22 advances one ball 11 through the secondary opening 36, wherein the ball 11 appears atop the finger cap 30. Once a ball 11 is beyond the secondary opening 36, the activation lever 24 is released, the push rod 28 drops and the cylindrical spacer 40 retracts. The flexible fingers 34 then return to their original configuration and the secondary opening 36 retreats to a diameter smaller than that of the ball 11. This isolates the ball 11 on top of the flexible fingers 34. The ball 11 is then sitting atop the batting tee system 10 and is ready to be struck with a bat.

From the above, it will be understood that the batting tee system 10 holds multiple balls 11 within its structure. However, should the batting tee system 10 be hit with a bat or fall over, the balls 11 in reserve are not spilled. The balls 11 within the batting tee system 10 can be advanced to the top of the batting tee system 10 one ball at a time by simply pressing the activation lever 24. As such, multiple balls 11 can be sequentially loaded onto the batting tee system 10 without the batter having to bend and physically set the balls 11.

After the balls 11 are struck into the field, the batting tee system 10 is inverted and is used to capture the balls 11 simply by pressing the batting tee system 10 against the balls 11. The balls 11 captured are automatically loaded in position for use when batting from the tee.

It will be understood that the embodiment of the present invention that is illustrated and described is merely exemplary and that a person skilled in the art can make many variations to the embodiment. All such embodiments are intended to be included within the scope of the present invention as defined by the claims.

What is claimed is:

1. A batting tee system, comprising:

a tube body having a first end, a second end, and an interior between said first end and said second end, wherein said first end is open and provides access to said interior, and wherein said interior has a first diameter at said second end;

flexible fingers that extend from said first end of said tube body, wherein said flexible fingers define a secondary opening that is concentrically aligned with said first end of said tube body, and wherein said secondary opening has a second diameter that is smaller than said first diameter; and a cylindrical spacer that extends from said first end of said tube body, wherein said cylindrical spacer can move reciprocally between a retracted position and an extended position, wherein when in said extended position, said cylindrical spacer contacts and spreads said flexible fingers, therein expanding said secondary opening to a diameter that is larger than said first diameter.

2. The system according to claim 1, further including an activation mechanism for mechanically moving said cylindrical spacer between said retracted position and said extended position.

3. The system according to claim 2, wherein said activation mechanism includes a lever that causes said cylindrical spacer to move when said lever is manually depressed.

4. The system according to claim 1, wherein said interior of said tube body is sized to receive balls having a diameter smaller than said first diameter but larger than said second diameter.

5. The system according to claim 4, further including a spring disposed in said tube body for biasing any balls placed in said interior of said tube body toward said first end.

6. The system according to claim 1, further including at least one elastic ring that biases said flexible fingers toward one another.

7. The system according to claim 1, further including a support for holding said tube body in a vertical orientation.

8. The system according to claim 7, wherein said support is collapsible and is affixed to said tube body.

9. The system according to claim 1, further including at least one handle on said tube body for carrying and inverting said tube body.

10. A batting tee system, comprising:

a tube body having an interior and an open first end, wherein said open first end has a first diameter;

an expandable constraint disposed at said first end of said tube body, wherein said expandable constraint defines a secondary opening that can be selectively altered between a second diameter that is smaller than said first diameter of said tube body, and a third diameter that is larger than said first diameter; and a mechanical activator that alters said secondary opening of said expandable constraint between said second diameter and said third diameter.

11. The system according to claim 10, wherein said mechanical activator includes a lever that causes said mechanical activator to expand when said lever is manually depressed.

12. The system according to claim 10, wherein said interior of said tube body is sized to receive balls having a diameter smaller than said first diameter but larger than said second diameter.

13. The system according to claim 12, further including a spring disposed in said tube body for biasing any balls placed in said interior of said tube body toward said first end.

14. The system according to claim 10, wherein said expandable constraint automatically expands from said second diameter to said third diameter when a ball is biased against said secondary opening from outside said tube body.

15. The system according to claim 10, further including a support for holding said tube body in a vertical orientation.

16. The system according to claim 15, wherein said support is collapsible and is affixed to said tube body.

17. The system according to claim 10, further including at least one handle on said tube body for carrying an inverting said tube body.

18. A method of teeing a ball on a batting tee, comprising:

providing a batting tee having a tube body, wherein said tube body has an interior and an open first end of a first diameter;

providing an expandable constraint at said first end of said tube body, wherein said expandable constraint defines a secondary opening that can be selectively altered between a second diameter that is smaller than said first diameter and a third diameter that is larger than said first diameter;

at least partially filling said tube body with a ball, wherein said ball has a ball diameter that is larger than said second diameter and smaller than both said first diameter and said third diameter;

biasing said ball against said expandable constraint from within said tube body;

momentarily expanding said secondary opening of said expandable constraint from said second diameter to a third diameter, therein enabling said ball to pass said expandable constraint and rest atop said expandable constraint.

19. The method according to claim 18, wherein at least partially filling said tube body with a ball includes biasing said ball against said expandable constraint from outside said tube body, therein momentarily expanding said secondary opening from said second diameter to said third diameter and enabling said ball to pass said expandable constraint and rest atop said expandable constraint.

* * * * *